US007441972B2

(12) United States Patent
Sugimoto et al.

(10) Patent No.: US 7,441,972 B2
(45) Date of Patent: Oct. 28, 2008

(54) ROLL SHEET HOLDER AND TAPE PRINTER

(75) Inventors: Kiyoshi Sugimoto, Kuwana (JP); Keiji Seo, Nagoya (JP); Akira Sago, Seto (JP); Atsushi Kasugai, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/896,578

(22) Filed: Sep. 4, 2007

(65) Prior Publication Data

US 2008/0003044 A1 Jan. 3, 2008

Related U.S. Application Data

(60) Division of application No. 11/497,382, filed on Aug. 2, 2006, now Pat. No. 7,381,002, which is a continuation of application No. 10/974,921, filed on Oct. 28, 2004, now Pat. No. 7,104,712.

(30) Foreign Application Priority Data

Jan. 6, 2004 (JP) ..... 2004-001037

(51) Int. Cl.
*B41J 11/00* (2006.01)

(52) U.S. Cl. ..... 400/613; 400/601; 400/613.1; 271/9.1; 347/198

(58) Field of Classification Search ..... 400/601, 400/605, 613, 613.1, 619, 649; 101/35; 347/198; 271/9.05, 9.06, 9.07
See application file for complete search history.

(56) References Cited

U.S. PATENT DOCUMENTS 4,179,077 A * 12/1979 Morishita ..... 242/423
5,486,259 A 1/1996 Goodwin et al.
6,030,133 A 2/2000 Endo
6,045,211 A 4/2000 Tokuda
6,053,648 A 4/2000 Mistyurik
6,183,153 B1 2/2001 Kamoda et al.
6,241,407 B1 * 6/2001 Huggins et al. ..... 400/611
6,347,897 B2 2/2002 Huggins et al.
6,367,731 B1 4/2002 Takizawa et al.
6,431,492 B1 * 8/2002 Chillscyzn ..... 242/577
6,501,498 B2 12/2002 Takahashi et al.
6,609,844 B1 8/2003 Petteruti et al.
6,695,500 B2 2/2004 Kim et al.
7,011,464 B2 3/2006 Sekino
7,070,346 B2 * 7/2006 Fujimori ..... 400/76
7,104,712 B2 * 9/2006 Sugimoto et al. ..... 400/613
7,232,268 B2 * 6/2007 Sugimoto et al. ..... 400/242
2003/0164994 A1 * 9/2003 Inana ..... 358/498

FOREIGN PATENT DOCUMENTS

JP A 2001-270660 10/2001

* cited by examiner

*Primary Examiner*—Leslie J. Evanisko
*Assistant Examiner*—Matthew G Marini
(74) *Attorney, Agent, or Firm*—Oliff & Berridge, PLC

(57) ABSTRACT

A tape printer includes a holder support member at one side end in a roll sheet holder storage part in a direction substantially perpendicular to a feeding direction. In the holder support member, a mounting piece which is substantially rectangular in section and formed protruding outward on a positioning holding member of a roll sheet holder is fitted. The tape printer further includes a flat portion formed substantially horizontally between a rear edge of an insertion opening through which a roll sheet is inserted into the tape printer. On the flat portion, a front portion of a guide member is placed. At a rear edge of the flat portion in the feeding direction, at plural positions corresponding to various kinds of the roll sheets having different widths, there are formed four second positioning grooves in which part of the guide member is fitted.

12 Claims, 13 Drawing Sheets

3
20
44
45
36
40
43
42
60
48
35
47
12
13
37
55
56
57
12A
43A
43B
43C
62
Y
Z
10m
20m
30m

ROLL SHEET HOLDER AND TAPE PRINTER

This is a Divisional of application Ser. No. 11/497,382, filed Aug. 2, 2006, now U.S. Pat. No. 7,381,002 which in turn is a Continuation of application Ser. No. 10/974,921 filed, Oct. 28, 2004, now U.S. Pat. No. 7,104,712 B2. The entire disclosures of the prior applications are hereby incorporated by reference herein in their entirety.

BACKGROUND OF THE INVENTION

1. Field of the Invention

The present invention relates to a roll sheet holder which rotatably holds a roll sheet wound on a cylindrical sheet core and is removably mounted in a tape printer provided with a feeding device for feeding the roll sheet and a printing unit for printing on the roll sheet. Further, the present invention relates to a tape printer in which the roll sheet holder is removably mounted.

2. Description of Related Art

Heretofore, various types of tape printers have been proposed to print characters and others on a long sheet formed of a self-adhesive sheet applied with a release sheet by means of a thermal head. Some tape printers of this type are provided with a roll sheet wound on a sheet core, a roll sheet holder which rotatably holds therein the sheet core, a support mechanism which removably mounts the roll sheet holder in the tape printer, and a feeding device for feeding part of the roll sheet while drawing the roll sheet from the roll sheet holder. The roll sheet holder may be selected from among plural holders of different sizes individually corresponding to plural sheet widths.

For instance, one of such roll sheet holders is disclosed in Japanese patent unexamined publication No. 2001-270660. This roll sheet holder, which is used in a tape printer provided with a feeding device for feeding part of a roll sheet wound on a sheet core, detachably holds the roll sheet wound on the sheet core and is rotatably mounted in the tape printer. Specifically, the roll sheet holder comprises a first support shaft which is inserted in a cylindrical through hole of the sheet core at one end thereof, a second support shaft which is inserted in the through hole of the sheet core at the other end thereof and is removably engaged with an end face of the support shaft, and a guide member which is slidably fitted on the outer periphery of the first support shaft and held in contact with the end face of the roll sheet. The first support shaft has a first flange formed on the periphery of the outer end face of the first support shaft, one or more slide grooves formed in the periphery of the first support shaft in the axial direction thereof, and a plurality of guide grooves formed extending from each slide groove in a peripheral direction and spaced apart at predetermined intervals in the axial direction of the first support shaft. The second support shaft has a second flange which is formed on the periphery of the outer end face of the second support shaft and held in contact with the end face of the roll sheet. The guide member has one or more locking piece(s) which formed protruding radially inwardly from a sliding surface of the guide member and is fitted in the slide groove or guide groove. When the locking piece is engaged in the corresponding guide groove, the roll sheet is allowed to be held between the second flange of the second support shaft and the guide member.

The above roll sheet holder can provide the following advantages. In the case where the roll sheet holder is demounted from the tape printer to replace the roll sheet with another one of a different width and then is mounted again in the tape printer, the roll sheet can easily and surely be set in the holder. It is also possible to prevent the loss of parts of the roll sheet holder, thus preventing failures caused due to the loss of parts. Consequently, product reliability can be enhanced.

However, the conventional tape printer which mounts the above mentioned roll sheet holder has the following disadvantages. To rotatably support the roll sheet holder, it is necessary to mount additional two unit holders on the right and left sides respectively and then fit the mounting piece protruding outside each unit holder in a pair of unit support members vertically provided on the inside bottom of the tape printer. The tape printer has to be provided with the pair of unit holders in addition to the guide member fitted on the outer periphery of the first support shaft. This would result in an increase in number of parts and a complicated structure, leading to a troublesome mounting work of the roll sheet holder. The pair of unit support members and others need be provided on the inside bottom of the tape printer, which makes it difficult to achieve a reduction in size of the tape printer.

SUMMARY OF THE INVENTION

The present invention has been made in view of the above circumstances and has an object to overcome the above problems and to provide a roll sheet holder having a simple structure formed of parts smaller in number, whereby making it easy to promptly mount each of various roll sheets of different widths in a tape printer and to contribute to a reduction in size of the tape printer.

To achieve the purpose of the invention, there is provided a roll sheet holder which holds a roll sheet wound on a cylindrical sheet core having a through hole opening at both ends and is removably mountable in a tape printer which includes a feeding device which draws the roll sheet to feed an unwound part thereof, and a printing device which prints on the part of the roll sheet fed by the feeding device, wherein the tape printer comprises: an insertion opening through which the unwound part of the roll sheet is inserted in the tape printer; a positioning support member vertically provided in a side end of a bottom of the tape printer so that one side of the positioning support member is positioned substantially in one plane with one side end of the insertion opening; a first positioning groove which is formed in the positioning support member to open upward and at both sides in a direction of a width of the tape printer; and a positioning recess formed with a predetermined depth in the bottom of the tape printer to face a lowermost end of the roll sheet, the recess being rectangular in plan view and long sideways along a direction of width of the roll sheet; and the roll sheet holder comprises; a guide member which is arranged in contact with one end of the roll sheet and has a first extended portion extending downward in a predetermined length to be fitted in the positioning recess when the roll sheet holder is mounted in the tape printer; a positioning holding member which is arranged in contact with the other end face of the roll sheet; the positioning holding member comprises: a positioning rib provided protruding in a longitudinal shape on an outer surface of the positioning holding member at a substantially center of a width thereof, the positioning rib being fitted in the first positioning groove when the roll sheet holder is mounted in the tape printer, thereby positioning the roll sheet holder in place in the tape printer; and a guide part formed on an outer surface of the positioning rib and extending outwards in a predetermined length from each of both sides of the outer surface of the positioning rib to have a larger width than the positioning rib; and the positioning rib will be fitted in the positioning groove while the positioning support member is positioned between the outer surface of the positioning holding member and the guide part.

The above roll sheet holder is adapted such that the positioning rib of the positioning holding member is inserted into the positioning support member while the positioning support member is positioned between an outer end face of the positioning holding member and an inner surface of the guide part extending outwards in a predetermined length from each of both sides of an outer end face of the positioning rib to have a larger width than the positioning rib. This makes it possible to ensure the positioning of the roll sheet holder with respect to the tape printer.

Further, the inner surface of the guide part of the positioning holding member is brought into contact with the outer surface of the positioning groove. Accordingly, the positioning rib can easily be positioned in the positioning groove, thereby enabling easy and prompt mounting of the roll sheet holder in the tape printer.

Further, the lower end of the first extended portion of the guide member is fitted in the positioning recess formed with a predetermined depth in the bottom of the tape printer. This structure, cooperating with the positioning holding member, makes it possible to readily prevent the roll sheet holder from rotating or rattling at the time of drawing or unwiding the roll sheet. Thus, the tape printer can repeatedly precisely draw part of the roll sheet by a fixed length by means of the feeding device, improving a print quality. The positioning recess is of a rectangular shape in plan view, which is long sideways along a direction of width of the roll sheet. Accordingly, the lower end of the first extended portion of each of the roll sheet holders having different widths can surely be fitted in the positioning recess. Thus, the tape printer can repeatedly precisely draw part of each of the roll sheets of different widths by a fixed length by means of the feeding device, improving a print quality.

According to another aspect, the present invention provides a roll sheet holder which holds a roll sheet wound to centrally form a through hole and is removably mountable in a tape printer which includes a feeding device which draws the roll sheet to feed an unwound part thereof, and a printing device which prints on the part of the roll sheet fed by the feeding device, wherein the tape printer comprises: an insertion opening through which the unwound part of the roll sheet is inserted in the tape printer; a positioning support member vertically provided in a side end of a bottom of the tape printer so that one side of the positioning support member is positioned substantially in one plane with one side end of the insertion opening; a first positioning groove which is formed in the positioning support member to open upward and at both sides in a direction of a width of the tape printer; and a positioning recess formed with a predetermined depth in the bottom of the tape printer to face a lowermost end of the roll sheet, the recess being rectangular in plan view and long sideways along a direction of width of the roll sheet; and the roll sheet holder comprises; a guide member which is arranged in contact with one end of the roll sheet and has a first extended portion extending downward in a predetermined length to be fitted in the positioning recess when the roll sheet holder is mounted in the tape printer; a positioning holding member which is arranged in contact with the other end face of the roll sheet; the positioning holding member comprises: a positioning rib provided protruding in a longitudinal shape on an outer surface of the positioning holding member at a substantially center of a width thereof, the positioning rib being fitted in the first positioning groove when the roll sheet holder is mounted in the tape printer, thereby positioning the roll sheet holder in place in the tape printer; and a guide part formed on an outer surface of the positioning rib and extending outwards in a predetermined length from each of both sides of the outer surface of the positioning rib to have a larger width than the positioning rib; and the positioning rib will be fitted in the positioning groove while the positioning support member is positioned between the outer surface of the positioning holding member and the guide part.

The above roll sheet holder is adapted such that the positioning rib of the positioning holding member is inserted into the positioning support member while the positioning support member is positioned between an outer end face of the positioning holding member and an inner surface of the guide part extending outwards in a predetermined length from each of both sides of an outer end face of the positioning rib to have a larger width than the positioning rib. This makes it possible to ensure the positioning of the roll sheet holder with respect to the tape printer.

Further, the inner surface of the guide part of the positioning holding member is brought into contact with the outer surface of the positioning groove. Accordingly, the positioning rib can easily be positioned in the positioning groove, thereby enabling easy and prompt mounting of the roll sheet holder in the tape printer.

Further, the lower end of the first extended portion of the guide member is fitted in the positioning recess formed with a predetermined depth in the bottom of the tape printer. This structure, cooperating with the positioning holding member, makes it possible to readily prevent the roll sheet holder from rotating or rattling at the time of drawing or unwiding the roll sheet. Thus, the tape printer can repeatedly precisely draw part of the roll sheet by a fixed length by means of the feeding device, improving a print quality. The positioning recess is of a rectangular shape in plan view, which is long sideways along a direction of width of the roll sheet. Accordingly, the lower end of the first extended portion of each of the roll sheet holders having different widths can surely be fitted in the positioning recess. Thus, the tape printer can repeatedly precisely draw part of each of the roll sheets of different widths by a fixed length by means of the feeding device, improving a print quality.

Further, according to another aspect, the present invention provides a roll sheet holder which holds a roll sheet wound on a cylindrical sheet core having a through hole opening at both ends and is removably mountable in a tape printer which includes a feeding device which draws the roll sheet to feed an unwound part thereof, and a printing device which prints on the part of the roll sheet fed by the feeding device, wherein the tape printer comprises: an insertion opening through which the unwound part of the roll sheet is inserted in the tape printer; a positioning support member vertically provided in a side end of a bottom of the tape printer so that one side of the positioning support member is positioned substantially in one plane with one side end of the insertion opening; a first positioning groove which is formed in the positioning support member to open upward and at both sides in a direction of a width of the tape printer; a placing part provided upstream from the insertion opening in a sheet feeding direction; and a second positioning groove which is formed on an upper side of the placing part to open rearward in the sheet feeding direction; the roll sheet holder comprises: a guide member which is arranged in contact with one end of the roll sheet and has a front-side extended portion extending outwards so that a front end of the front-side extended portion is positioned outside a front end of the roll sheet of a maximum diameter in the sheet feeding direction; and a positioning holding member which is arranged in contact with the other end face of the roll sheet and has a positioning rib provided protruding in a longitudinal shape on an outer surface of the positioning holding member at a substantially center of a width thereof, the positioning rib being fitted in the first positioning groove when the roll sheet holder is mounted in the tape printer, thereby positioning the roll sheet holder in place in the tape printer.

Furthermore, when the positioning rib protruding on the outer surface of the positioning holding member is aligned with and fitted in the first positioning groove formed opening upward of the tape printer, the lower end of the front-side extended portion of the guide member is engaged in the second positioning groove, thereby removably holding the roll sheet holder in the tape printer. It is therefore possible to easily mount the roll sheet holder in the tape printer.

Further, according to another aspect, the present invention provides a roll sheet holder which holds a roll sheet wound to centrally form a through hole and is removably mountable in a tape printer which includes a feeding device which draws the roll sheet to feed an unwound part thereof, and a printing device which prints on the part of the roll sheet fed by the feeding device, wherein the tape printer comprises: an insertion opening through which the unwound part of the roll sheet is inserted in the tape printer; a positioning support member vertically provided in a side end of a bottom of the tape printer so that one side of the positioning support member is positioned substantially in one plane with one side end of the insertion opening; a first positioning groove which is formed in the positioning support member to open upward and at both sides in a direction of a width of the tape printer; and a placing part provided upstream from the insertion opening in a sheet feeding direction; and a second positioning groove which is formed on an upper side of the placing part to open rearward in the sheet feeding direction; the roll sheet holder comprises: a guide member which is arranged in contact with one end of the roll sheet and has a front-side extended portion extending outwards so that a front end of the front-side extended portion is positioned outside a front end of the roll sheet of a maximum diameter in the sheet feeding direction, and; a positioning holding member which is arranged in contact with the other end face of the roll sheet and has a positioning rib provided protruding in a longitudinal shape on an outer surface of the positioning holding member at a substantially center of a width thereof, the positioning rib being fitted in the first positioning groove when the roll sheet holder is mounted in the tape printer, thereby positioning the roll sheet holder in place in the tape printer.

Furthermore, when the positioning rib protruding on the outer surface of the positioning holding member is aligned with and fitted in the first positioning groove formed opening upward of the tape printer, the lower end of the front-side extended portion of the guide member is engaged in the second positioning groove, thereby removably holding the roll sheet holder in the tape printer. It is therefore possible to easily mount the roll sheet holder in the tape printer.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of a roll sheet holder and a tape printer embodying the present invention will now be given referring to the accompanying drawings.

A schematic structure of the tape printer in the embodiment is first explained below with reference to FIGS. 1 through 7.

Figure 1:
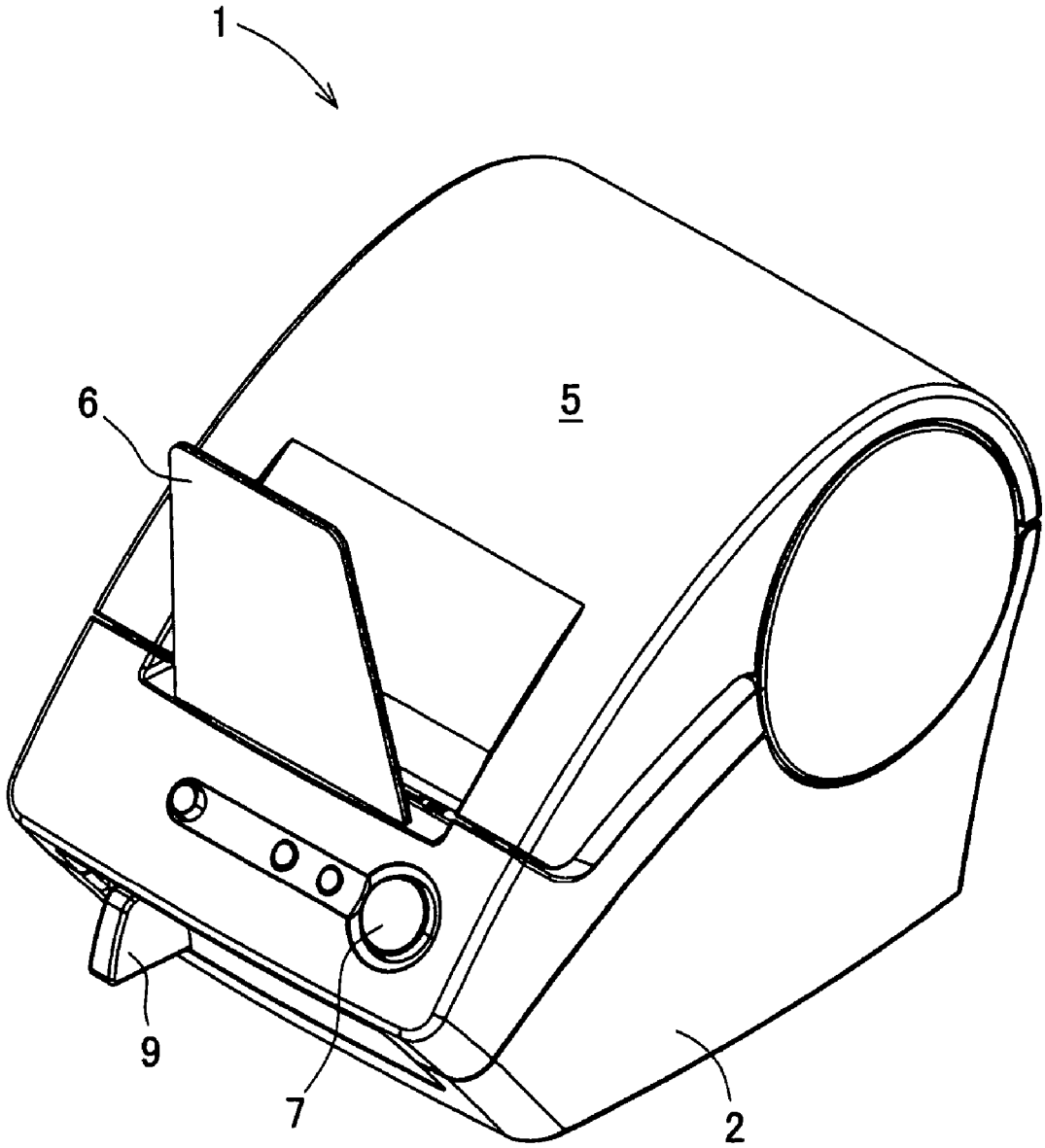
FIG. 1 is a schematic perspective view of a tape printer in a first embodiment.
Figure 2:
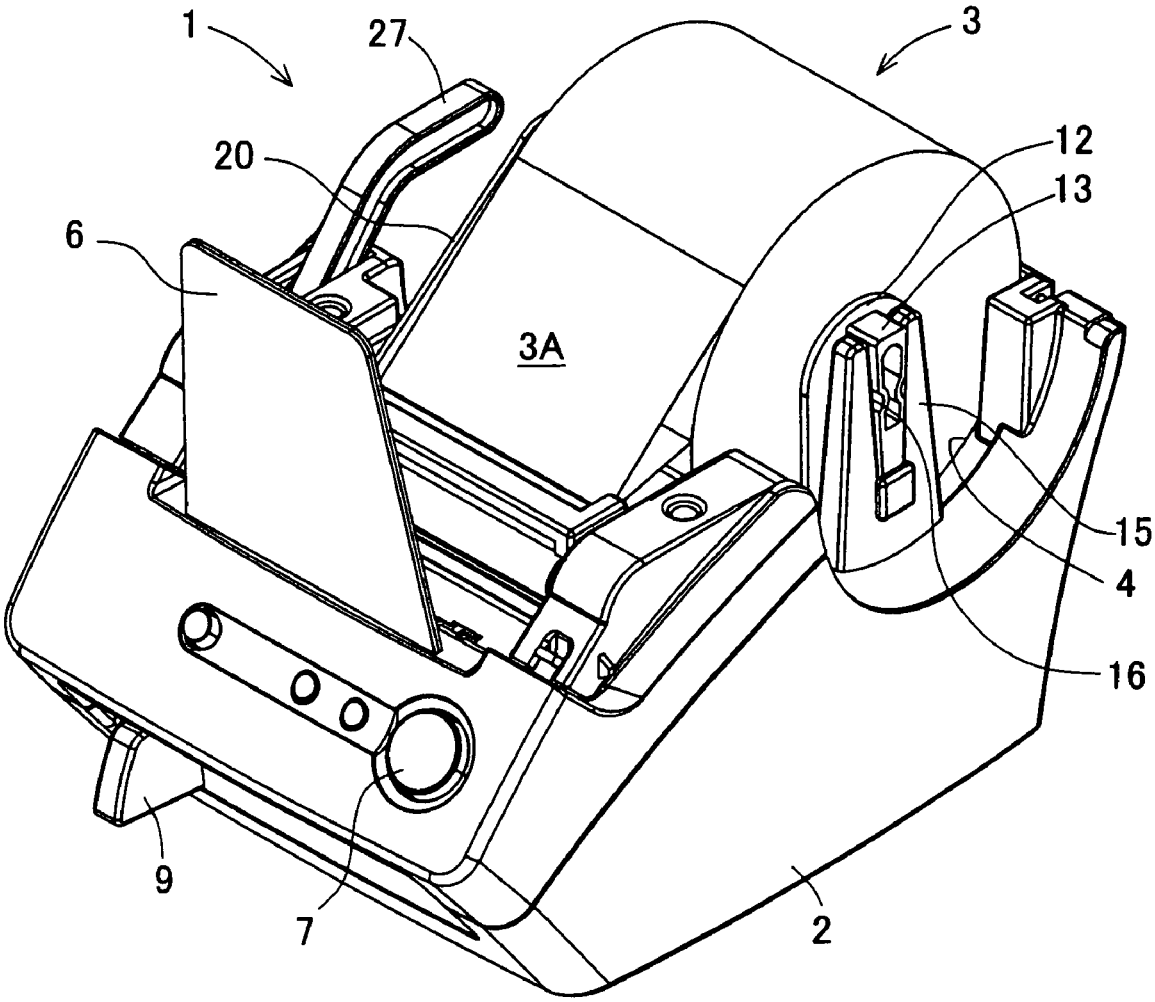
FIG. 2 is a perspective view of the tape printer of which a top cover is removed, in which a roll sheet holder holding a roll sheet of a maximum width is mounted.
Figure 3:
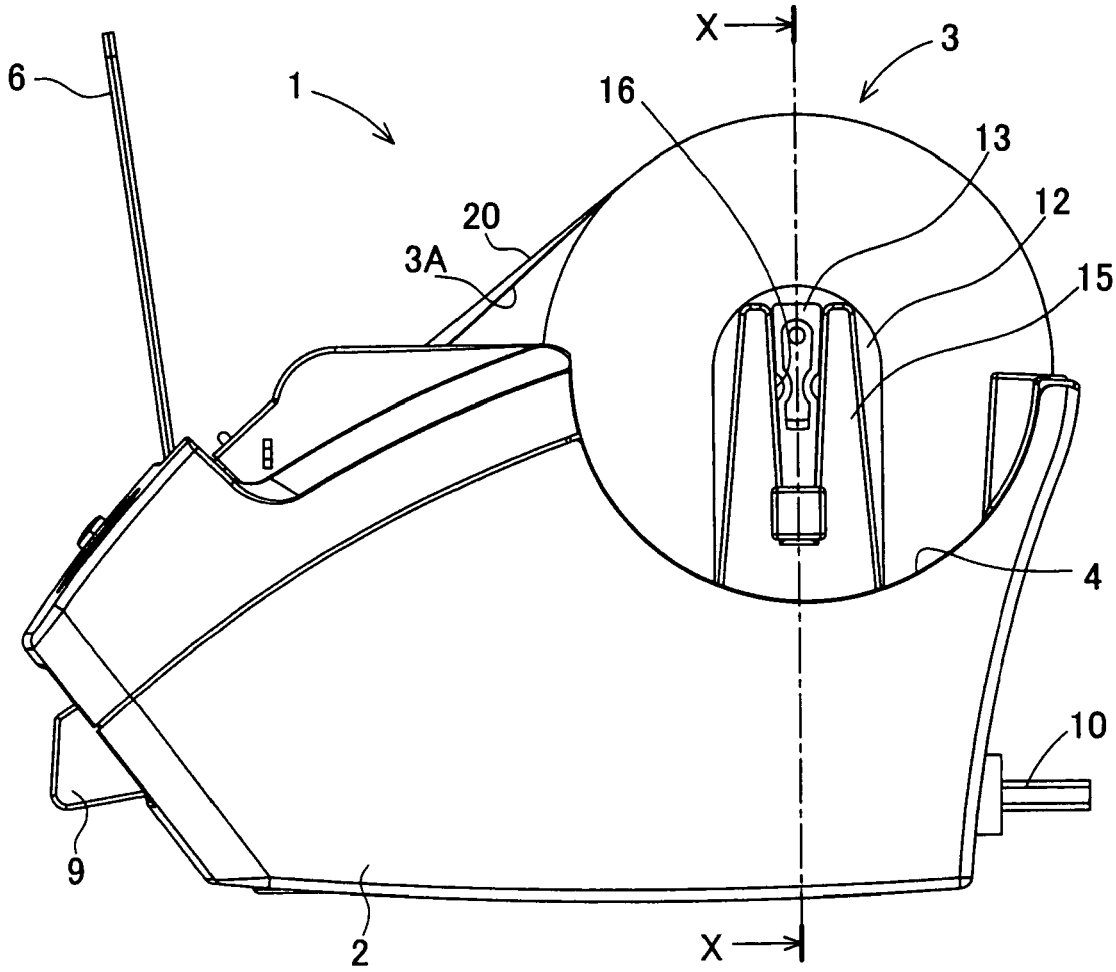
FIG. 3 is a side view of the tape printer of FIG. 2.
Figure 4:
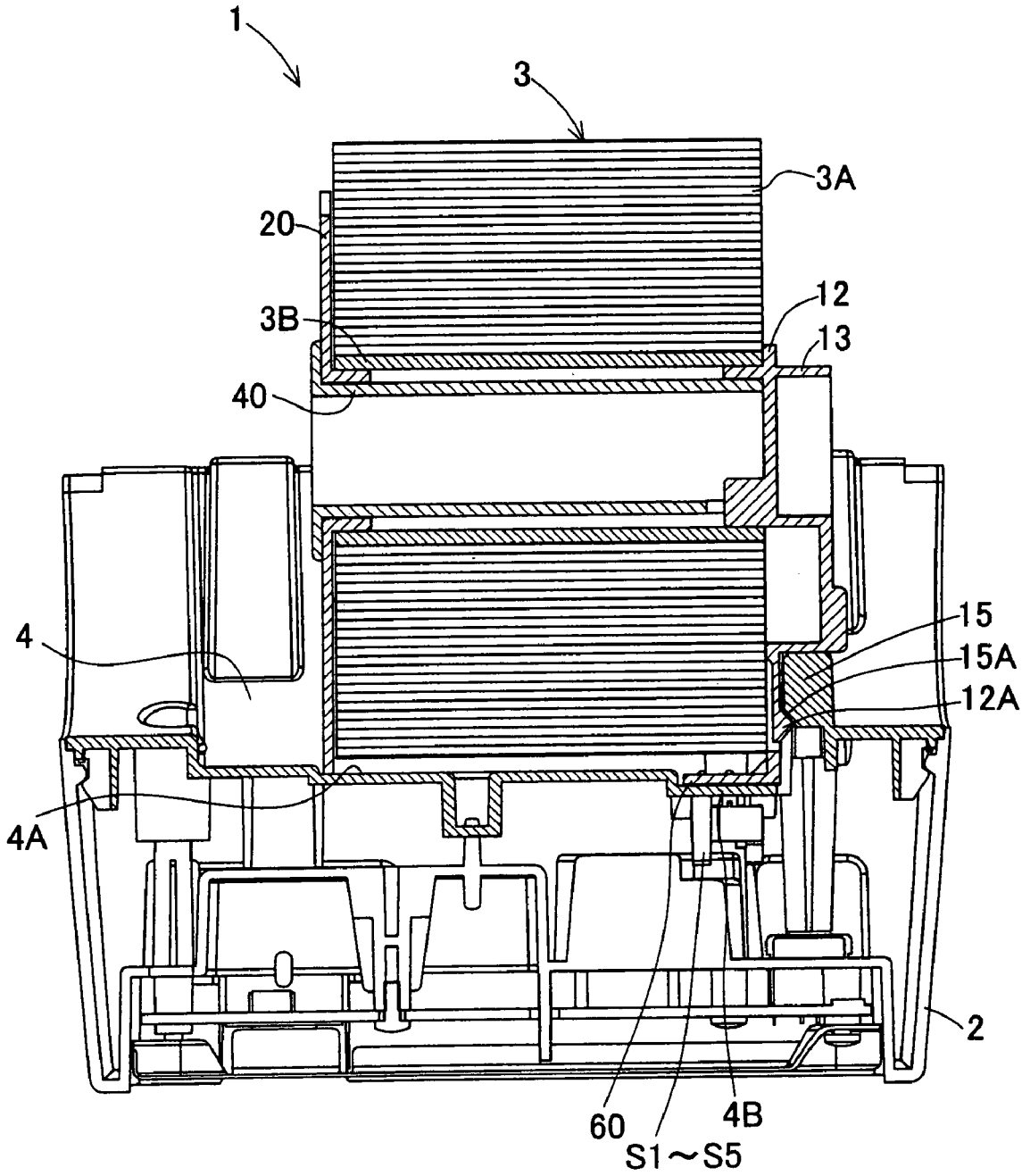
FIG. 4 is a sectional view taken along a line X-X in FIG. 3.
Figure 5:
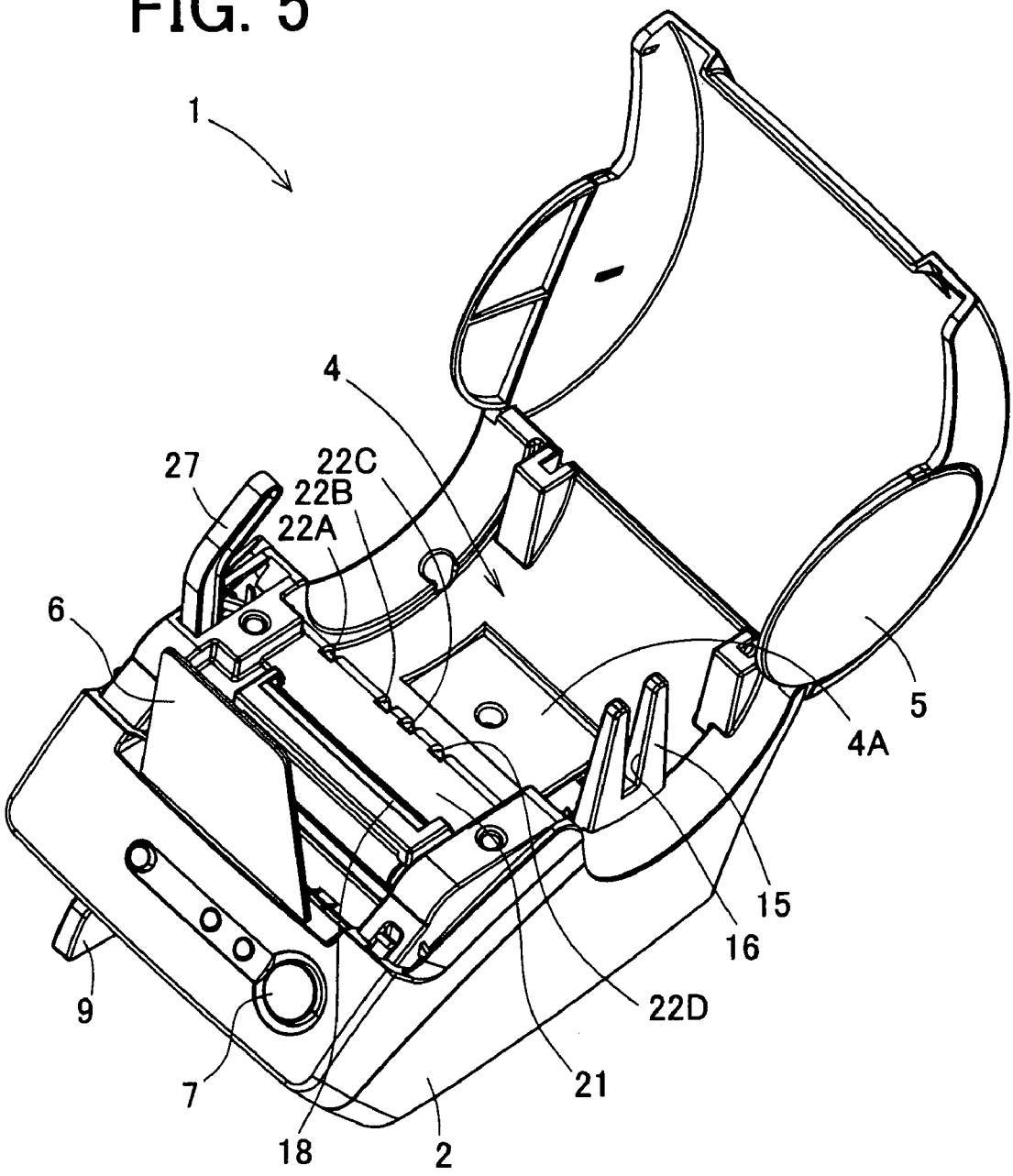
FIG. 5 is a schematic perspective view of the tape printer in the first embodiment, in which the top cover is opened.
Figure 6:
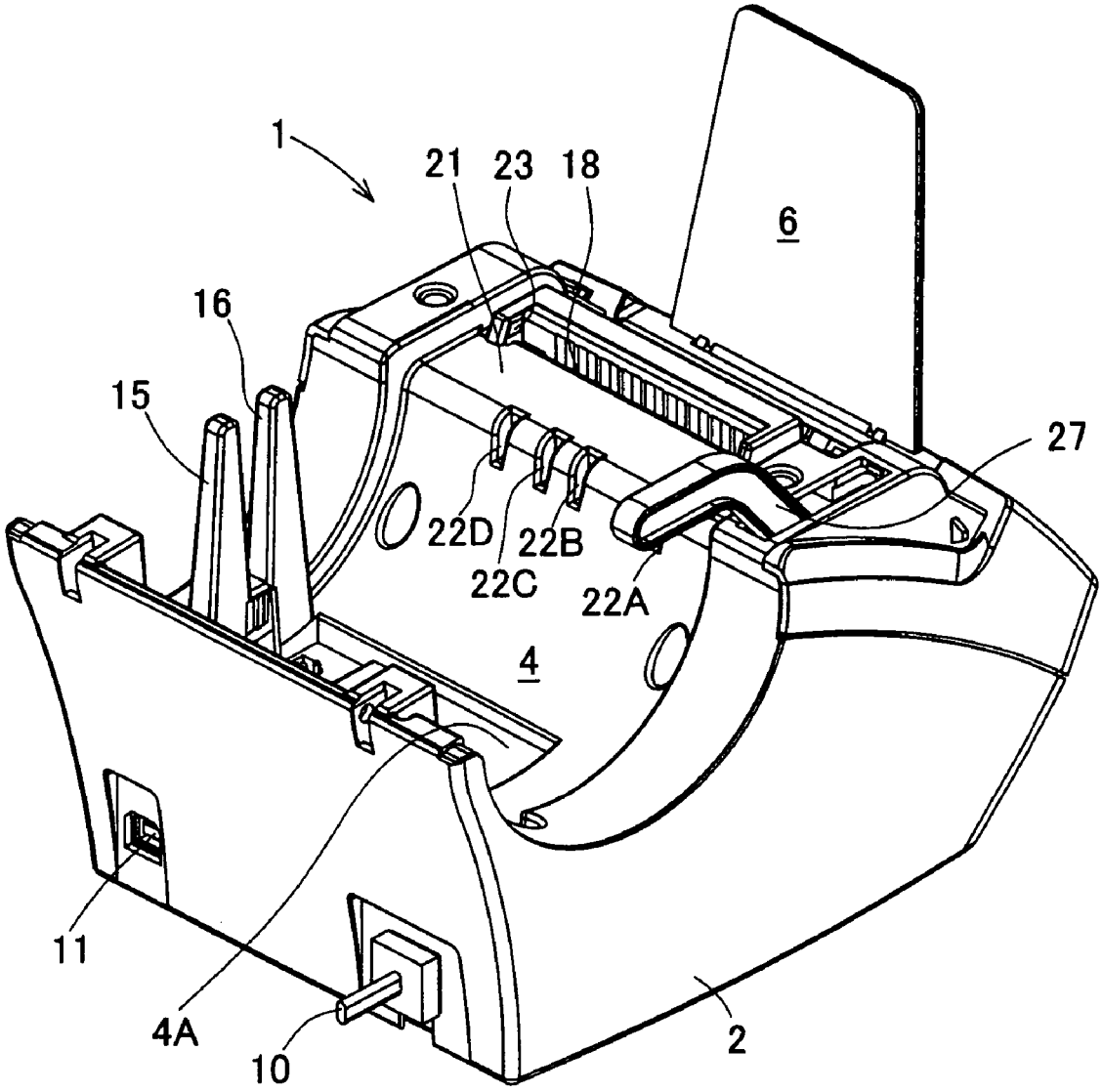
FIG. 6 is a schematic back perspective view of the tape printer in the first embodiment, from which the top cover is removed.

As shown in FIGS. 1 to 3, the tape printer 1 includes a housing 2, a top cover 5 made of transparent resin attached to the housing 2 at a rear upper edge, a tray 6 made of transparent resin set in a vertical position to face a substantially front center of the top cover 5, a power button 7 placed in front of the tray 6, a cutter lever 9 provided in a front face of the housing 2, and others. The top cover 5 is freely opened and closed, thereby covering an upper part of a roll sheet holder storage part (hereinafter, a "holder storage part") 4 which is a space for receiving a roll sheet holder 3 holding a roll sheet 3A of a predetermined width. The cutter lever 9 is movable side to side to horizontally move a cutter unit 8 (see FIG. 7). A power cord 10 is connected to the housing 2 on a back face near a corner. The housing 2 is provided on the back face near the other corner with a connector part 11 (see FIG. 6) such as a USB (Universal Serial Bus) which is connected to for example a personal computer not shown. The roll sheet 3A is a long thermal sheet (so-called "thermal paper") having a self color development property or a long label sheet formed of the thermal sheet whose one surface is bonded with a release sheet by adhesive. The roll sheet 3A is in a wound state around a hollow cylindrical sheet core 3B (see FIG. 4).

As shown in FIGS. 2 through 6, the tape printer 1 is provided with a holder support member 15 in the holder storage part 4 at a side end (a left side end in FIG. 6) in a substantially perpendicular direction to, a sheet feeding direction (in which an unwound part of the roll sheet is fed from a rolled portion of the roll sheet to a platen roller mentioned later. The holder support member 15 receives a mounting piece (a positioning rib) 13 of a positioning holding member (hereinafter, a "holding member") 12 constructing the roll sheet holder 3 mentioned later. The mounting piece 13 is provided protruding in a substantially longitudinal rectangular shape on the outer surface of the holding member 12. Specifically, the holder support member 15 is shaped like an angled U-shape as seen in side view of the printer 1, providing a first positioning groove 16 which opens upward in the tape printer 1 and toward both side surfaces of the holder support member 15 in a direction of the width of the tape printer 1. The holder support member 15 is also formed with a recess 15A which engages an elastic locking piece 12A formed projecting at a lower end of the holding member 12.

Figure 7:
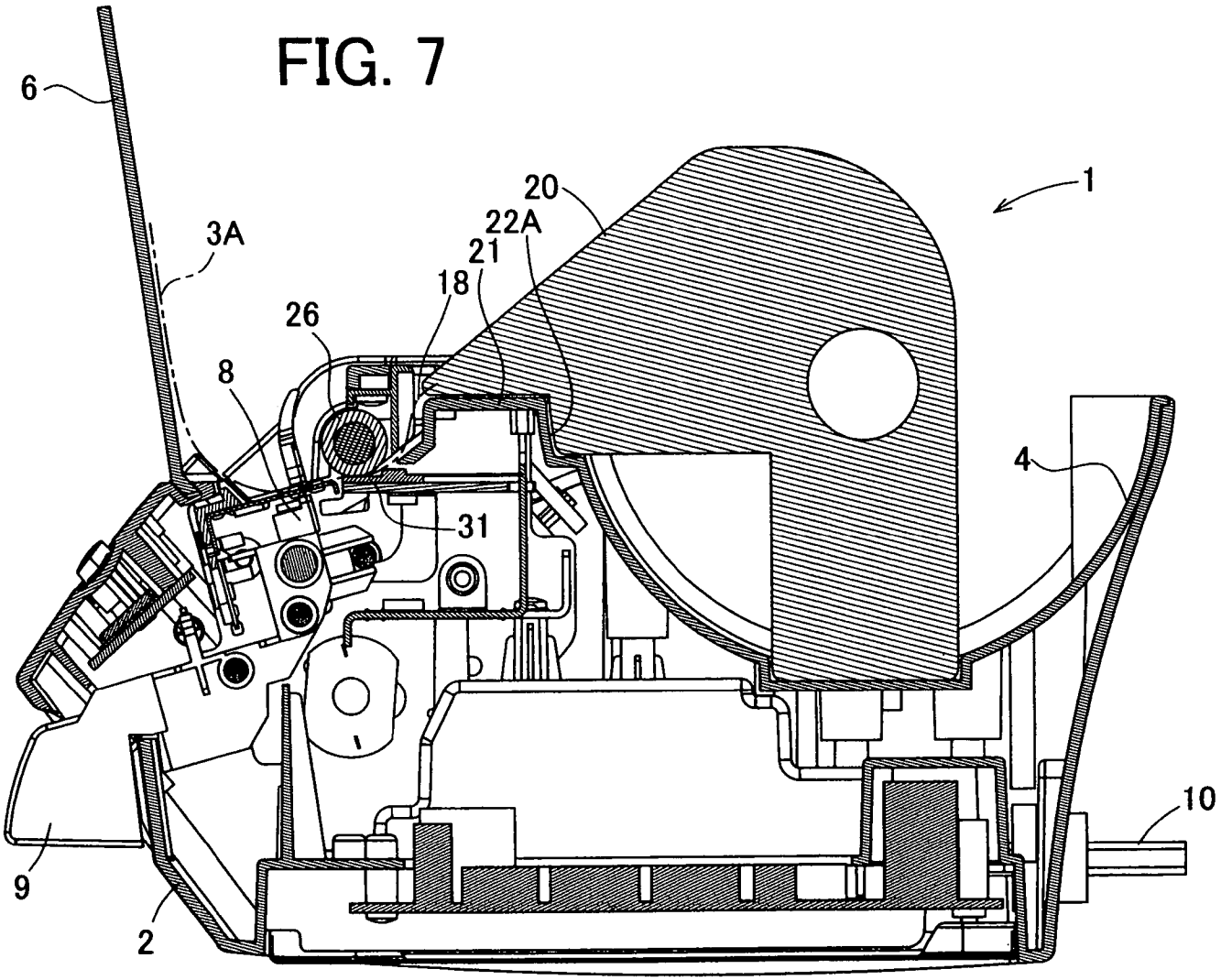
FIG. 7 is a sectional side view of the tape printer in the first embodiment, from which the top cover is removed.

The housing 2 is formed with an insertion opening 18 through which a leading end of an unwound part of the roll sheet 3A is inserted into the housing 2. A flat portion 21 is formed substantially horizontal between a rear end (in the feeding direction) of the opening 18 and a front upper edge portion of the holder storage part 4. On this flat portion 21, a front end portion of a guide member 20 of the roll sheet holder 3 is placed. The flat portion 21 is provided at a rear corner in the feeding direction with second positioning grooves (four grooves in the present embodiment) 22A to 22D each formed by a substantially L-shaped wall in section and positioned corresponding to each of a plurality of roll sheets 3A of different widths. Each of the second positioning grooves 22A to 22D is configured to fittingly receive a front part of the guide member 20 inserted from above, as shown in FIG. 7. Further, the front end of the guide member 20 of the roll sheet holder 3 extends to the insertion opening 18.

A positioning recess 4A is formed in the bottom of the holder storage part 4. The positioning recess 4A is rectangular in plan view and long sideways in a direction substantially perpendicular to the feeding direction, extending from an inner base end of the holder support member 15 to a position corresponding to the second positioning groove 22A. This positioning recess 4A has a predetermined depth (about 1.5 mm to 3.0 mm in the first embodiment). The width of the positioning recess 4A in the feeding direction is determined to be almost equal to the width of each lower end portion of the holding member 12 and the guide member 20. A discrimination recess 4B is provided between the positioning recess 4A and the inner base end of the holder support member 15. This discrimination recess 4B is rectangular in plan view, which is long in the feeding direction, and has a depth larger by a predetermined amount (about 1.5 mm to 3.0 mm in the first embodiment) than the positioning recess 4A. The discrimination recess 4B will receive a sheet discrimination part 60 (see FIG. 8B) mentioned later which extends inward from the lower end of the holding member 12 at a right angle therewith.

In the discrimination recess 4B, there are provided five sheet discrimination sensors S1, S2, S3, S4, and S5 arranged in an L-shaped pattern for distinguishing the kind (e.g., width) of the roll sheet 3A. These sensors S1 to S5 are each constructed of a push type microswitch or the like, specifically, a well known mechanical switch including a plunger and a microswitch. It is detected whether the sheet discrimination part 60 has sensor holes (through holes) 60A (see FIG. 8B), mentioned later, at the positions corresponding to the sheet discrimination sensors S1 to S5 respectively. Based on an ON/OFF signal representing a detection result by the sensors S1 to S5, the kind of the roll sheet 3A held in the roll sheet holder 3 is detected. In the first embodiment, the tape discrimination sensors S1 to S5 are allowed to normally protrude from the bottom surface of the discrimination recess 4B to near the bottom surface of the positioning recess 4A, that is, at the height substantially corresponding to a depth difference between the discrimination recess 4B and the positioning recess 4A. At this time, each microswitch is in an OFF state.

In the case where the sheet discrimination part 60 has some sensor hole(s) 60A to 60E at the positions corresponding to the sheet discrimination sensors S1 to S5, the plunger(s) of the sensor(s) for which the sheet discrimination part 60 has sensor hole(s) is allowed to pass through the associated sensor holes 60A to 60E without depression, leaving the corresponding microswitch(es) in the OFF state, which generates an OFF signal.

On the other hand, the plunger(s) of the sensor(s) for which the sheet discrimination part 60 has no sensor hole(s) is depressed, bringing the corresponding microswitch(es) into the ON state, which generates an ON signal.

The insertion opening 18 is arranged so that its one side end (a left end in FIG. 6) on the holder support member 15 side in the tape printer 1 is positioned substantially in one plane with the inner surface of the holder support member 15 in which the positioning groove 16 opens, more properly, in one plane with the inner surface of the positioning member 12 when engaged in the holder support member 15. In the insertion opening 18, a guide rib 23 is formed on the side end near the holder support member 15.

A lever 27 for operating the vertical movement of a thermal head (see FIG. 7) is provided in front of the other side end (a left end in FIG. 5) of the holder storage part 4 in the feeding direction. To be more specific, when the lever 27 is turned up, the thermal head 31 is moved down and separated from a platen roller 26 disposed facing the thermal head 31 (see FIG. 7). When the lever 27 is turned down, to the contrary, the thermal head 31 is moved up, thereby pressing the unwound part of the roll sheet 3A against the platen roller 26. A printable condition is thus developed. Further, below the roll sheet holder 4, there is provided a control board 32 on which a control circuit is formed to drive and control each mechanism in response to commands from an external personal computer and others.

The roll sheet holder 3 in which the roll sheet 3A wound on the sheet core 3B is removably set in the holder storage part 4 in the following manner. The mounting piece 13 of the positioning member 12 is inserted from above into the first positioning groove 16 of the holder support member 15. The elastic locking piece 12A formed projecting at the lower end of the positioning member 12 is then engaged in the locking recess 15A formed in the inner base end of the holder support member 15. A front lower portion (i.e., a fourth extended portion 45 mentioned later) of the guide member 20 is engaged in appropriate one of the second positioning grooves 22A to 22D and the lower end portion of the guide member 20 is fittingly inserted in the positioning recess 4A.

A user (operator) moves the lever 27 up and inserts a leading end of a unwound part of the roll sheet 3A into the insertion opening 18 while keeping one side edge of the unwound part of the roll sheet 3A in contact with the inner surface of the guide member 20 and the other side edge in contact with the guide rib 23 provided at the side end of the insertion opening 18. Thereafter, the user moves the lever 27 down. Printing is thus enabled.

As shown in FIG. 7, when the lever 27 is moved down, the part of the roll sheet 3A inserted in the insertion opening 18 is pressed against the platen roller 26 by means of the thermal head 31 of a line type. The platen roller 26 is driven to rotate by a step motor or the like not shown while the thermal head 31 is drivingly controlled to print image data on a print surface of the roll sheet 3A which is fed sequentially. The printed part of the roll sheet 3A discharged onto the tray 6 is cut by a cutter unit 8 when the user moves the cut lever 9 rightward.

A schematic structure of the roll sheet holder 3 is explained below with reference to FIGS. 8 through 12.

As shown in FIG. 8 through 12, the roll sheet holder 3 is constructed of the guide member 20, the holding member 12, and a holder shaft 40 of a substantially tube shape. The guide member 20 has a first cylindrical part 35 which is fitted in one open end of the sheet core 3B of the roll sheet 3A so that the guide member 20 is held in contact with one of the end faces of the roll sheet 3A. The holding member 12 has a second cylindrical part 37 which is fitted in the other open end of the sheet core 3B so that the holding member 12 is held in contact with the other end face of the roll sheet 3A. The holder shaft 40 has two open ends 40*a* and 40*b*; the one end 40*a* is fitted in the first cylindrical part 35 of the guide member 20 and formed with a radially extended flange part 36 fixed onto the outer surface of the guide member 20 and the other end 40*b* is fixedly fitted in the second cylindrical part 37 of the holding member 12. The holder shaft 40 may be selected from among a plurality of shafts of different lengths to easily provide many kinds of roll sheet holders 3 holding roll sheets 3A of different widths.

The guide member 20 further includes a first, second, third, and fourth extended portions 41, 42, 43, and 44. The first extended portion 42 is formed extending downward in a predetermined length from a lower periphery of an outer end face of the first cylindrical part 35. This first extended portion 42 is fitted in the positioning recess 4A formed in the bottom of the holder storage part 4 so that the lower end surface of the first extended portion 42 is brought in contact with the bottom surface of the positioning recess 4A. The second extended portion 43 is formed extending upward to cover a front quarter round of the end face of the roll sheet 3A. The third extended portion 44 is formed continuously extending from the second extended portion 43 up to near the insertion opening 18 (see FIG. 6) and has an upper edge sloped downward to the front end. This third extended portion 44 further has a lower edge (44*a*) extending horizontally, which is held in contact with the flat portion 21 of the tape printer 1 so that one side edge of the unwound part of the roll sheet 3A is guided along the inner surfaces of the second and third extended portions 43 and 44 up to the insertion opening 18. The fourth extended portion 45 is formed under the third extended portion 44 between the rear end of the lower edge 44*a* at a predetermined distance from the front end and the first extended portion 42. When the lower edge 44*a* of the third extended portion 44 is held in contact with the flat portion 21, a front edge (45*a*) of the fourth extended portion 45 is inserted in appropriate one of the second positioning grooves 22A to 22D corresponding to the sheet width of the roll sheet 3A set in the sheet holder 3 (see FIG. 7).

The guide member 20 is further formed with slits 47 of a substantially rectangular shape in side view of the guide member 20, at an upper end of the first extended portion 42, i.e., at diametrical opposed positions of the periphery of the outer end face of the first cylindrical part 35. In these slits 47, protrusions 48 formed on the inner surface of the flange part 36 of the holder shaft 40 are engaged for positioning. In the guide member 20, scales 43A, 43B, and 43C are provided in concentric circular lines on the inner surfaces of the extended portions 43, 44, and 45. These scales 43A to 43C indicate the winding lengths of the roll sheet 3A; 10 m, 20 m, and 30 m. In the present embodiment, the maximum winding length of the roll sheet 3A set in the roll sheet holder 3 is about 30 m.

The holder shaft 40 is provided with a slit 51 in the end portion fitted in the second cylindrical part 37 of the holding member 12. The slit 51 has a predetermined length along the long direction of the shaft 40 to engage a rib 50 formed protruding radially inward from the inner lower end of the second cylindrical part 37. Such engagement between the rib 50 of the holding member 12 and the slit 51 of the holder shaft 40 makes it possible to correctly position the holding member 12 and the guide member 20 with respect to each other through the holder shaft 40.

The first and second cylindrical parts 35 and 37 serve to rotatably support the sheet core 3B of the roll sheet 3A. The holder shaft 40 may be selected from among a plurality of shafts (four shafts in the first embodiment) of different lengths individually corresponding to the lengths of the sheet cores 3B (i.e., the widths of the roll sheets 3A).

The outer open end of the second cylindrical part 37 is closed by the positioning member 12. A flange 55 is formed around the second cylindrical part 37. An extended portion 56 is continuously formed under the flange 55. Respective inner surfaces of the flange 55 and the extended portion 56 are held in contact with the end face of the roll sheet 3A and the sheet core 3B. On the outer surfaces of the flange 55 and the extended portion 56, the longitudinal mounting piece (positioning rib) 13 is provided protruding outward, at substantially the center of the width of the positioning member 12 in the feeding direction (a lateral direction in FIG. 10A). This mounting piece 13 is of a substantially rectangular section and a width which becomes smaller in a downward direction so that the mounting piece 13 is fitted in the first positioning groove 16 having a narrower width (in the feeding direction) towards the bottom of the holder support member 15 in the tape printer 1. The protruding distance of the mounting piece 13 is determined to be almost equal to the width (in a direction of the width of the tape printer 1, perpendicular to the feeding direction) of the first positioning groove 16.

The mounting piece 13 of the positioning member 12 is provided, on the lower outer surface, with a guide portion 57 of a square flat plate (about 1.5 mm to 3.0 mm in thickness in the first embodiment) having a larger width than the lower portion of the mounting piece 13 by a predetermined amount (about 1.5 mm to 3.0 mm in the first embodiment) at each side of the lower portion. Accordingly, to mount the roll sheet holder 3 in the tape printer 1, the user inserts the mounting piece 13 from above into the first positioning groove 16 by bringing an inner surface of the guide portion 57 into sliding contact with the outer surface of the holder support member 15. Thus, the roll sheet holder 3 can easily be fitted in place.

Figure 8A:
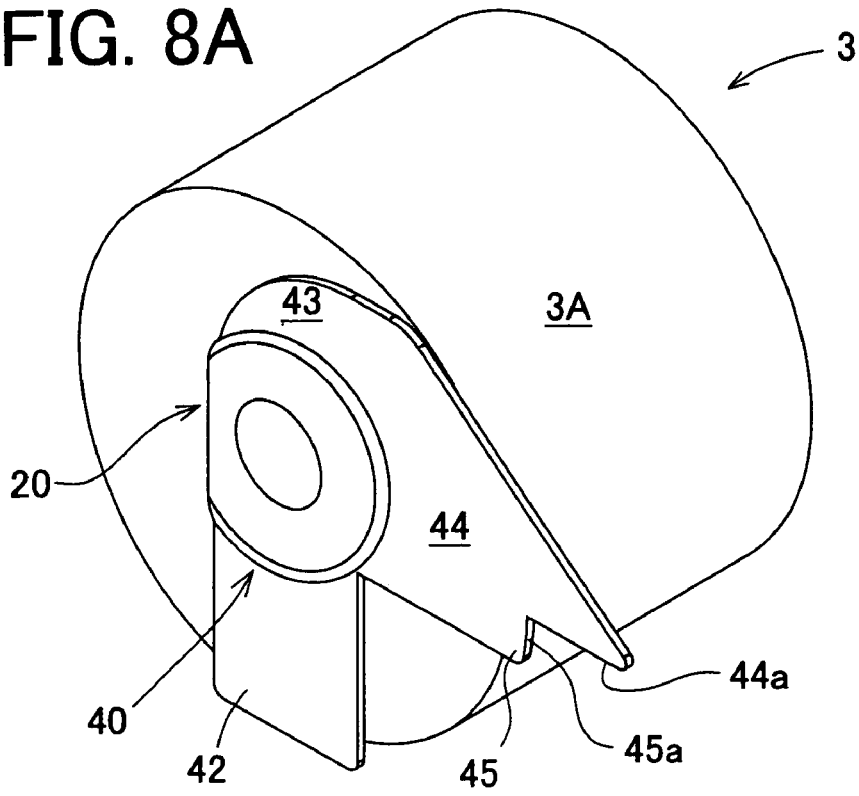
FIG. 8A is a perspective view of a roll sheet holder holding a roll sheet, seen from an obliquely front direction.
Figure 8B:
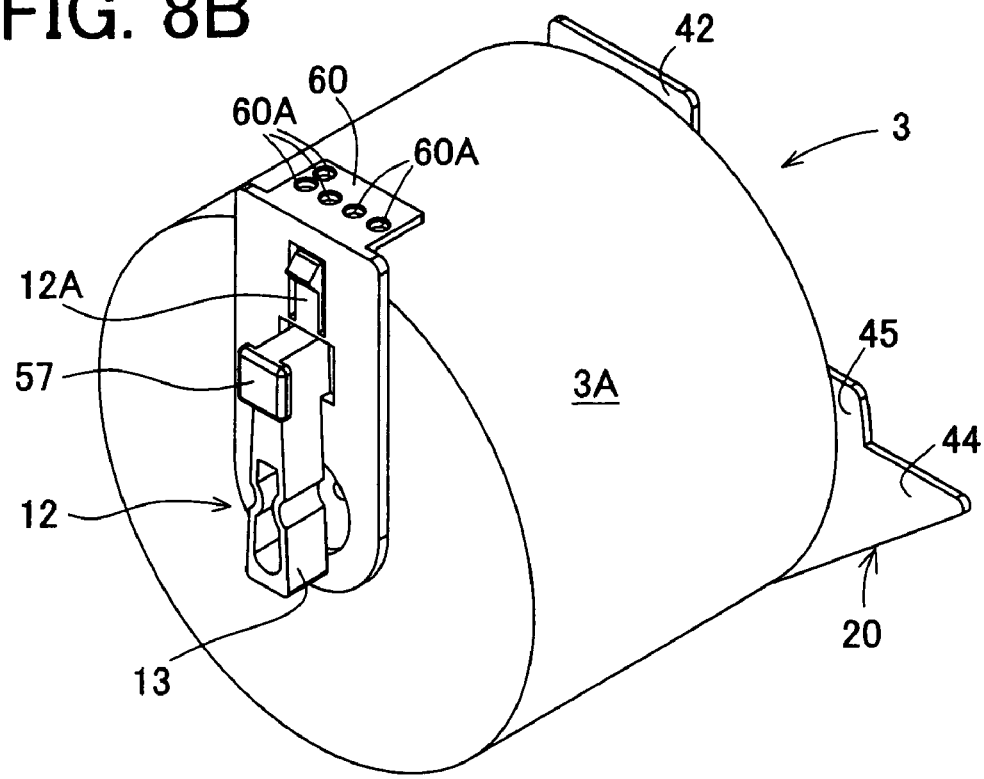
FIG. 8B is a perspective view of the roll sheet holder turned upside down, seen from an obliquely front direction.
Figure 9B:
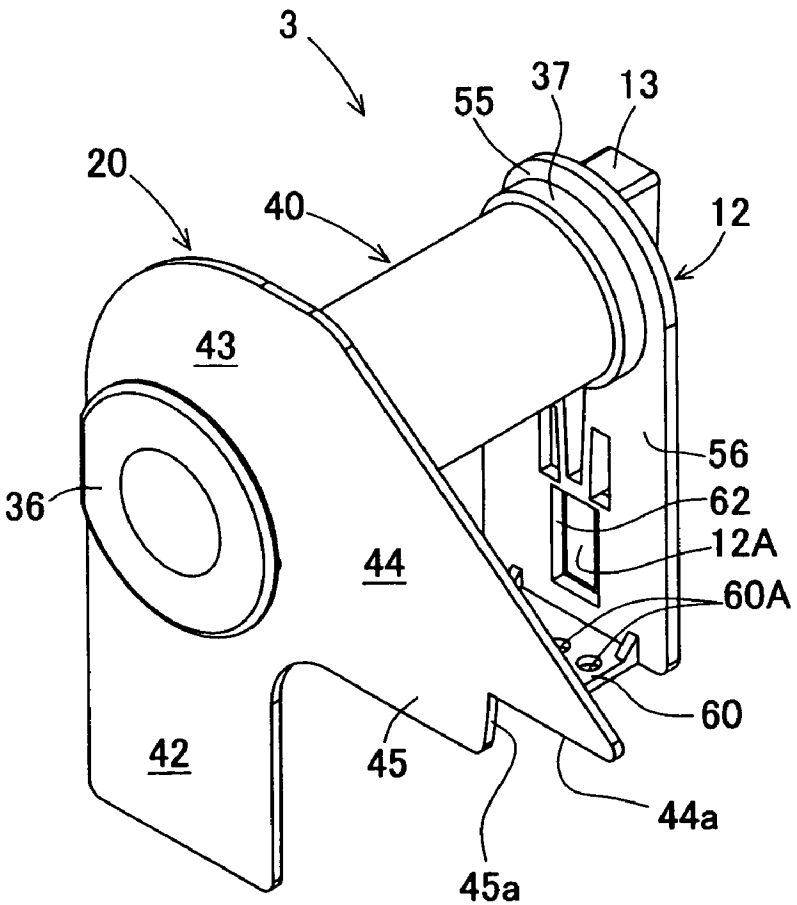
FIG. 9B is a perspective view of the roll sheet holder alone seen from an obliquely front direction.
Figure 9A:
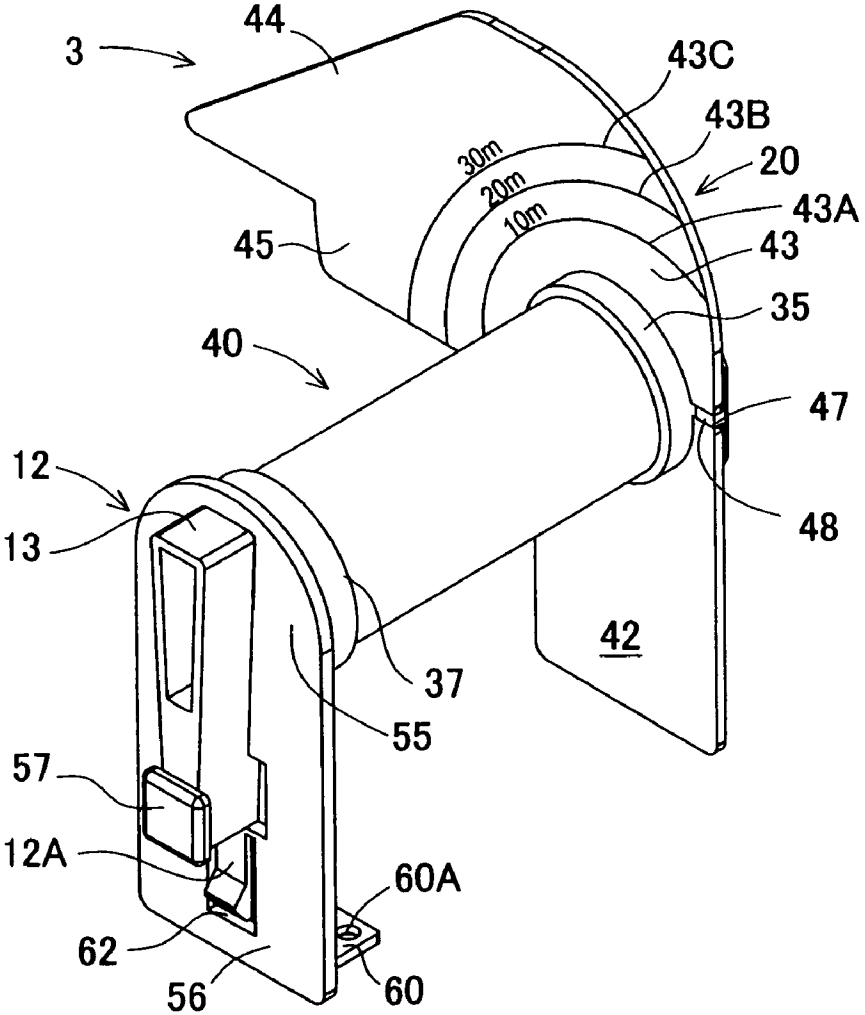
FIG. 9A is a perspective view of the roll sheet holder alone seen from an obliquely back direction.
Figures 10A, 10B, 10C:
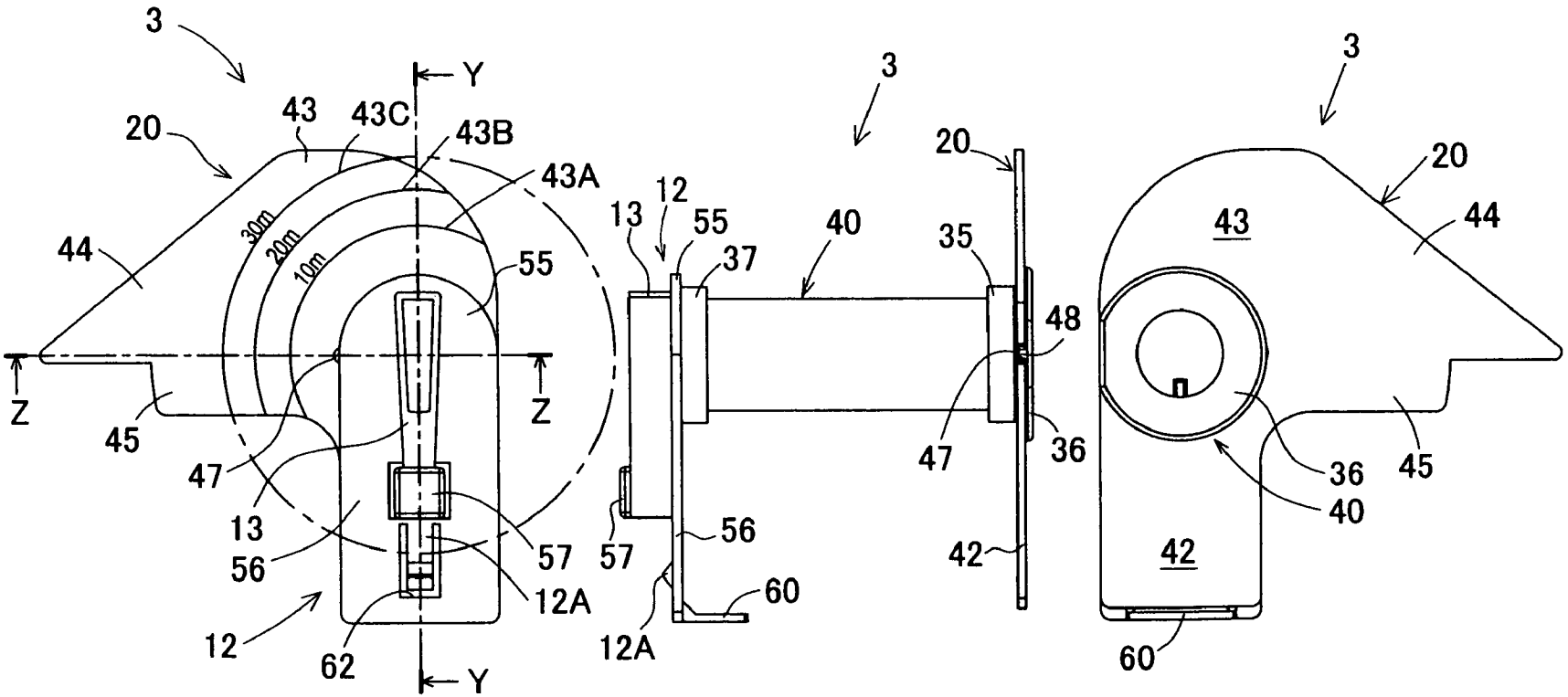
FIG. 10A is a side view of the roll sheet holder in the first embodiment, seen from left of the roll sheet holder in FIG. 10B.
FIG. 10B is a back view of the roll sheet holder in the first embodiment.
FIG. 10C is a side view of the roll sheet holder in the first embodiment.
Figure 11:
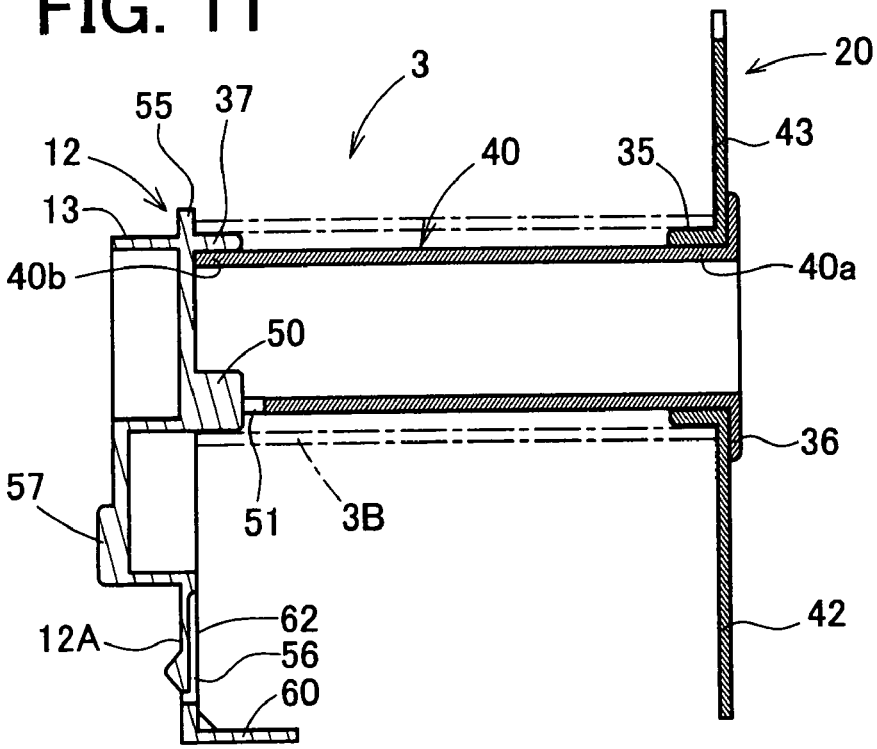
FIG. 11 is a sectional view of the roll sheet holder taken along a line Y-Y in FIG. 10A.
Figure 12:
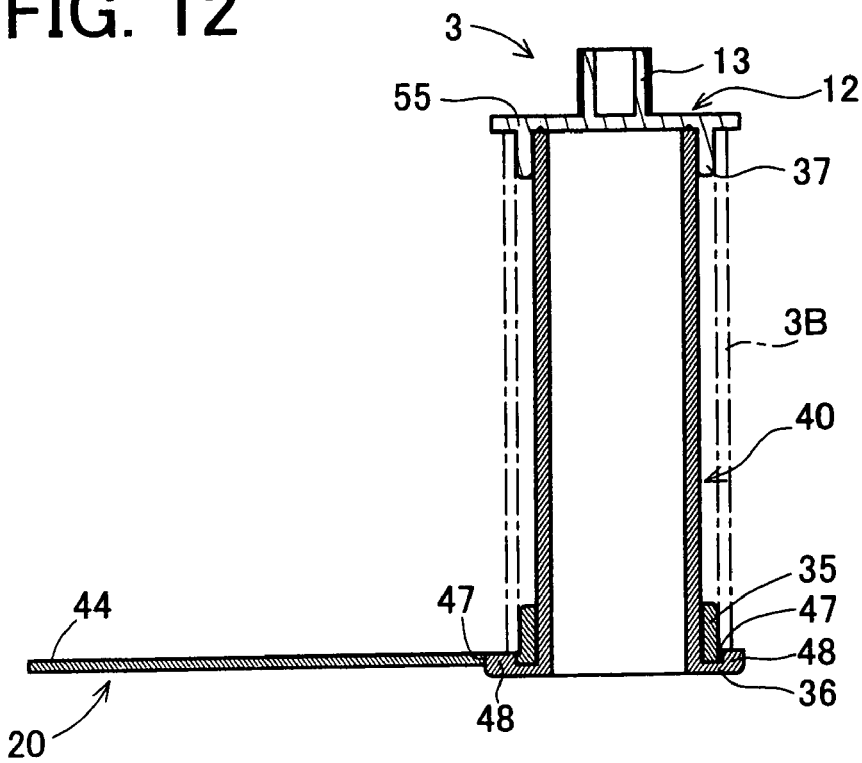
FIG. 12 is a sectional view of the roll sheet holder taken along a line Z-Z in FIG. 10A.

The positioning member 12 is designed to have the extended portion 56 extending downward longer by a predetermined length (about 1.0 mm to 2.5 mm in the first embodiment) than the lower end (the first extended portion 42) of the guide member 20. The positioning member 12 is also provided, at the lower end of the extended portion 56, with a sheet discrimination part 60 of a substantially rectangular shape extending inward by a predetermined length at almost right angle to the extended portion 56. As mentioned above, the sheet discrimination part 60 is formed with the sensor holes 60A arranged at predetermined positions corresponding to the sheet discrimination sensors S1 to S5 respectively. In FIG. 8B, five sensor holes 60A are arranged at predetermined positions for the kind of the roll sheet 3A set in the holder 3.

The positioning member 12 is further formed with a longitudinally rectangular through hole 62 in the extended portion 56 under the mounting piece 13. The elastic locking piece 12A is provided extending downward from the upper edge of the through hole 62 and formed with an outward protrusion at a lower end.

Figure 13B:
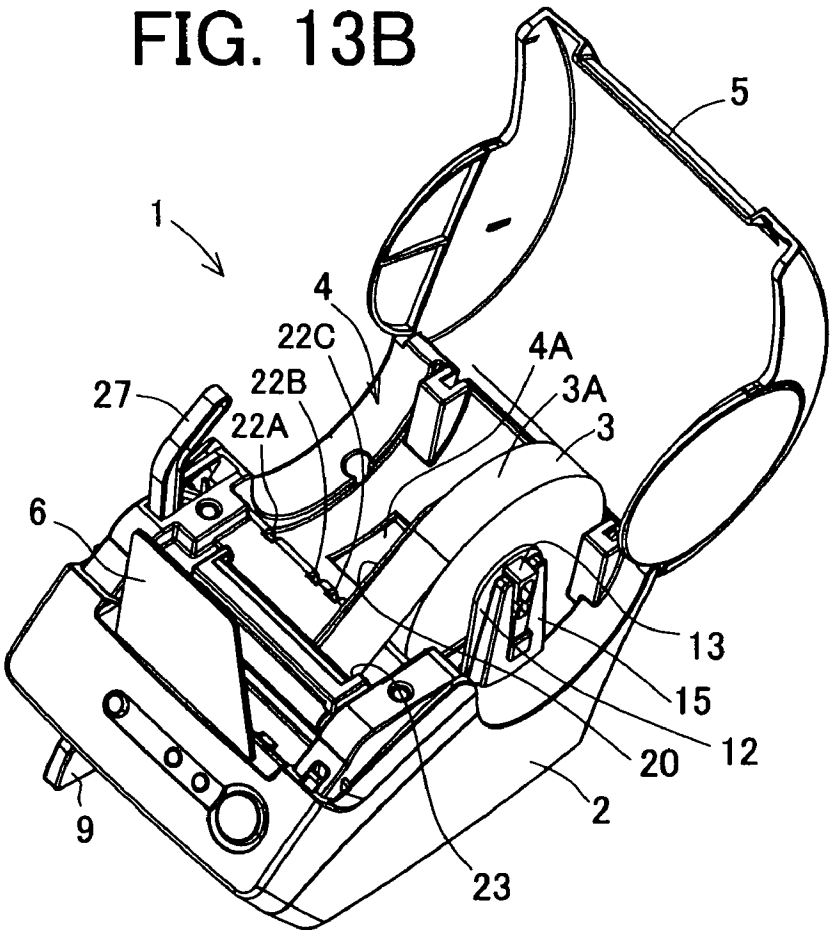
FIG. 13B is a perspective view of the tape printer in the first embodiment, in which the roll sheet holder for a minimum roll sheet width is mounted.
Figure 13A:
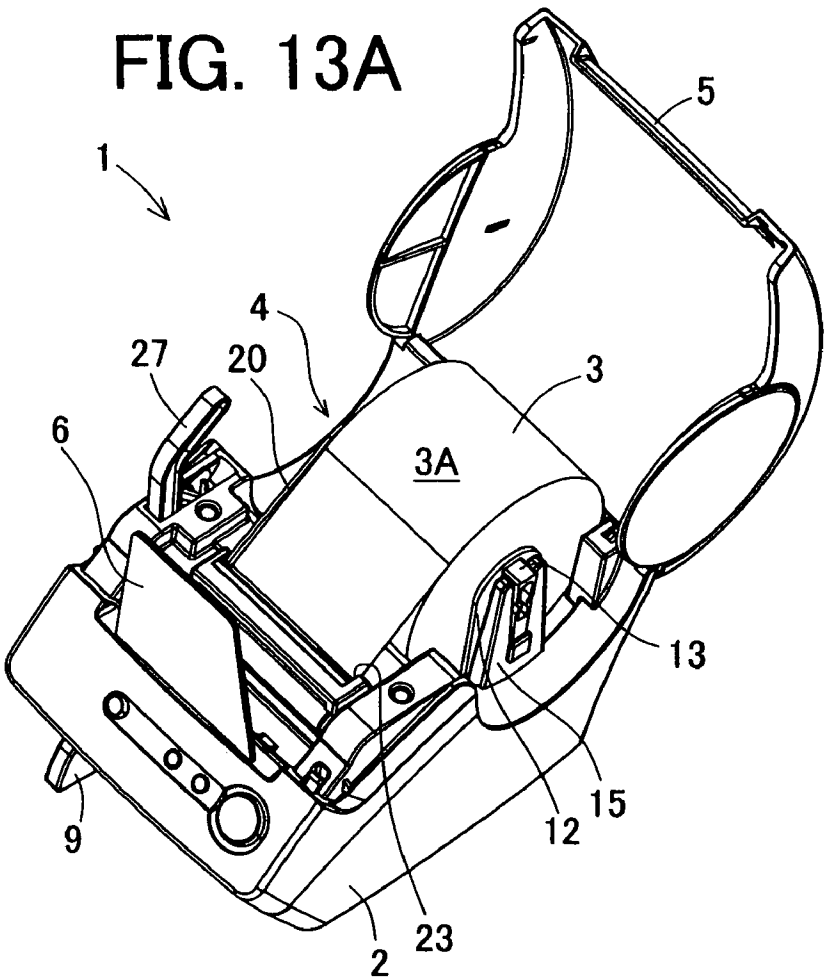
FIG. 13A is a perspective view of the tape printer in the first embodiment, in which the roll sheet holder for a maximum roll sheet width is mounted.

An explanation is given to a mounting manner of the roll sheet holder 3 constructed as above in the tape printer 1, referring to FIGS. 13A and 13B.

FIG. 13A shows the case where the roll sheet 3A holds a roll sheet 3A of a maximum width wound on a hollow cylindrical sheet core 3B. The mounting piece 13 of the holding member 12 of the holder 3 is first inserted from above into the positioning groove 16 of the holder support member 15. The holder 3 is put so that the lower edge 44*a* of the third extended portion 44 of the guide member 20 is brought into contact with the flat portion 21. The fourth extended portion 45 is engaged in the second positioning groove 22A formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess 4B formed at a position inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom.

Subsequently, the user turns the lever 27 upward and then draws (unwinds) part of the roll sheet 3A and inserts the leading end of the unwound part of the roll sheet 3A in the insertion opening 18 while guiding one side edge of the unwound part of the roll sheet 3A in contact with the inner surface of the guide member 20 and the other side end in contact with the protruding guide rib 23 provided on the side end of the insertion opening 18. Thereafter, the user turns the lever 27 down. The inserted portion of the roll sheet 3A is thus pressed against the platen roller 26 by the thermal head 31, bringing the roll sheet 3A into a printable state.

FIG. 13B shows the case where the roll sheet holder 3 holds a roll sheet 3A of a minimum width wound on a hollow cylindrical sheet core 3B. The mounting piece 13 of the holding member 12 of the holder 3 is first inserted from above into the positioning groove 16 of the holder support member 15. The sheet holder 3 is put so that the lower edge 44*a* of the third extended portion 44 of the guide member 20 is brought into contact with the flat portion 21. The fourth extended portion 45 is engaged in the second positioning groove 22D formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom.

Subsequently, the user turns the lever 27 up and then draws (unwinds) part of the roll sheet 3A to insert the leading end of the unwound part of the roll sheet 3A in the insertion opening 18 while guiding one side edge of the unwound part of the roll sheet 3A in contact with the inner surface of the guide member 20 and the other side edge in contact with the protruding guide rib 23 provided on the side end of the insertion opening 18. Thereafter, the user turns the lever 27 down. The inserted portion of the roll sheet 3A is thus pressed against the platen roller 26 by the thermal head 31, bringing the roll sheet 3A into a printable state.

The above components in the present embodiment correspond to each element of the invention as below. The platen roller 26 serves as a feeding device. The platen roller 26 and the thermal head 31 in combination construct a printing device. The first, second, third, and fourth extended portions 42, 43, 44, and 45 construct a first flange part. The second cylindrical part 37 serves as a second cylindrical part. The positioning holding member 12 serves as a positioning holding member whereby the roll sheet holder 3 is positioned in place in the tape printer 1. The flange part 36 serves as a second flange part. The mounting piece 13 serves as a positioning rib. The sheet discrimination part 60 serves as a fifth extended portion. Each scale 43A, 43B, and 43C serves as a length scale. The holder support member 15 and the locking recess 15A construct a support mechanism. Further, the holder support member 15 serves as a positioning support member. The flat portion 21 serves as a sixth extended portion. The holder storage part 4 serves as a seventh extended portion. The positioning recess 4A serves as a recess.

In the tape printer 1 in the first embodiment, as described above, the first positioning groove 16 in which the mounting piece 13 formed protruding on the outer surface of the flange 55 and the extended portion 56 in the roll sheet holder 3 is inserted is provided in the holder support member 15 disposed in the holder storage part 4 at one side end thereof. Accordingly, the roll sheet holder 3 can surely be positioned in place with reference to the one side end of the holder storage part 4. Each of the roll sheets 3A of different widths can be positioned in place and fed, leading to an improved print quality.

The roll sheet 3A in the roll sheet holder 3 is set in the holder storage part 4 having a curved surface concentric with the roll sheet 3A in sectional side view. Thus, while the roll sheet holder 3 is positioned easily in the feeding direction, the mounting piece 13 provided on the outer surfaces of the flange 55 and the extended portion 56 in the roll sheet holder 3 can be inserted in the first positioning groove 16. The roll sheet holder 3 can be mounted easily in the tape printer 1.

The roll sheet holder 3 is mounted in the tape printer 1 so that the roll sheet 3A faces the holder storage part 4 extending in a curve in sectional side view concentric with the roll sheet 3A. The fourth extended portion 45 of the guide member 20 of the roll sheet holder 3 is fitted in appropriate one of the second positioning grooves 22A-22D each formed by a substantially L-shaped wall in section at the rear corner of the flat portion 21 in the feeding direction, namely, the upper edge of the holder storage part 4 near the insertion opening 18. With this structure, the area of the tape printer 1 for mounting the roll sheet holder 3, that is, the size of the entire tape printer 1 can be reduced.

The guide member 20 of the roll sheet holder 3 can be fixed to the rear end of the flat portion 21 by engaging the fourth extended portion 45 in appropriate one of the second positioning grooves 22A-22D. This can eliminate the need of providing a support member or the like to support the other side end of the roll sheet holder 3 in the holder storage part 4. A reduction in number of parts and in manufacturing cost of the tape printer 1 can easily be achieved.

Further, at the side end of the insertion opening 18 which is on the holder support member 15 side of the tape printer 1, the guide rib 23 having a predetermined width in the feeding direction is formed along the side end of the insertion opening 18. A unwound part of the roll sheet 3A is guided into the insertion opening 18 along the surface of the guide rib 23 and the inner surfaces of the second extended portion 43 and the third extended portion 44 of the roll sheet holder 3. Thus, it is possible to prevent oblique insertion of the part of the roll sheet 3A into the insertion opening 18. Since the unwound part of the roll sheet 3A is not covered from the leading end at the rear edge of the guide rib 23 to the rolled periphery, the user is allowed to easily hold the leading end of the roll sheet 3A in inserting it into the insertion opening 18. Thus, a user can easily do the work of inserting the leading end of the roll sheet 3A into the insertion opening 18 and then easily and quickly make the work of mounting the roll sheet holder 3 in the tape printer 1.

According to various kinds of the roll sheets 3A having different widths, the second positioning grooves 22A-22D are arranged at corresponding positions at the rear corner of the flat part 21 which will face the fourth extended portion 45. With this structure, plural roll sheet holders 3 of different widths can selectively be removably mounted. In particular, there is no need to provide a moving mechanism for moving the support member which supports the other end of the roll sheet holder 3 in a direction of the roll sheet width and a fixing mechanism for fixing the support member with respect to the holder storage part 4. It is therefore possible to reduce the number of parts and the manufacturing cost of the tape printer 1.

As above, the lower end of the first extended portion 42 of the roll sheet holder 3 is fitted in the positioning recess 4A formed in the inside bottom of the roll sheet holder 4, thereby easily preventing, in cooperation with the holder support member 15, rotation and chattering of the roll sheet holder 3 which would be caused due to unwinding of the roll sheet 3A. The tape printer 1 can operate to repeatedly unwind (draw) a part of the roll sheet 3 by a required length through the platen roller 26, thus providing an improved print quality. Furthermore, the positioning recess 4A is rectangular in plan view and long sideways in the roll sheet width direction, which can surely receive the lower end of the first extended portion 42 of each of the roll sheet holders 3 having different widths. Accordingly, the tape printer 1 can repeatedly unwind each of the roll sheets of different widths by just a required length through the platen roller 26 and therefore the print quality can further be improved.

When the mounting piece 13 provided on the outer surface of the holding member 12 is inserted into the first positioning groove 16 opening upward in the tape printer, the fourth extended portion 45 of the roll sheet holder 3 is fitted in appropriate one of the second positioning grooves 22A-22D. In this manner, the roll sheet holder 3 can removably be mounted in the tape printer 1 and the roll sheet holder 3 can be replaced easily and quickly with another roll sheet holder holding a roll sheet of a different width.

The end face of the roll sheet 3A wound on the sheet core 3B is held in contact with the second and third extended portions 43 and 44 of the guide member 20 which extend to near the insertion opening 18 of the tape printer 1. Thus, one side end of the roll sheet 3A can be guided from the rolled upper portion to the insertion opening 18 by the second and third extended portions 43 and 44, so that the leading end of the roll sheet 3A can easily be inserted into the insertion opening 18. It is also possible to prevent the roll sheet 3A from obliquely going over the guide member 20.

By changing of only the length of the holder shaft member 40 according to the roll sheet 3A selected from among the plurality of roll sheets having different widths, the same guide member 20 and the same positioning holding member 12 may be used to construct a plurality of roll sheet holders 3 of various kinds. The number of parts of the roll sheet holders 3 can be reduced, leading to a reduction in manufacturing cost thereof.

The mounting piece 13 of the holding member 12 is slid in the first positioning groove 16 while the both surfaces of the support member 15 around the first positioning groove 16 are held between the outer surface of the holding member 12 and the inner surface of the guide portion 57 protruding outward from each side of the lower portion of the mounting piece 13 by a predetermined length. Accordingly, the roll sheet holder 3 can surely be positioned in place in the sheet width direction. The fourth extended portion 45 of the guide member 20 can also be fitted in appropriate one of the second positioning grooves 22A-22D correspondingly positioned.

Since the inner surface of the guide portion 57 of the holding member 12 is held in contact with the outer surface of the support member 15 around the first positioning groove 16, the mounting piece 13 can easily be aligned with respect to first positioning groove 16. The mounting of the roll sheet holder 3 can be made more easily and quickly.

The holding member 12 is provided, at the lower end of the extended portion 56, with the sheet distinction part 60 extending inward from the lower end by a predetermined length to face the lower portion of the outer peripheral surface of the roll sheet 3A of the maximum diameter. Even when a rolled state of the roll sheet 3A slightly loosens due to its elastic restoring force, a lower portion of the outer peripheral surface of the roll sheet 3A is pressed against the sheet distinction part 60. This makes it possible to surely prevent the roll sheet 3A from further loosening.

Moreover, the scales 43A-43C indicating the winding lengths of the roll sheet 3A are provided in concentric circular lines on the inner surface of the second extended portion 43 of the guide member 20, so that a remaining amount of the roll sheet 3A can be visually checked. The top cover 5 of the tape printer 1 is made of transparent resin, which makes it easy for users to easily become aware of the remaining amount of the roll sheet 3A during printing by viewing the scales 43A-43C. The users can replace the roll sheet holder 3 with another one with precise timing.

Figure 14:
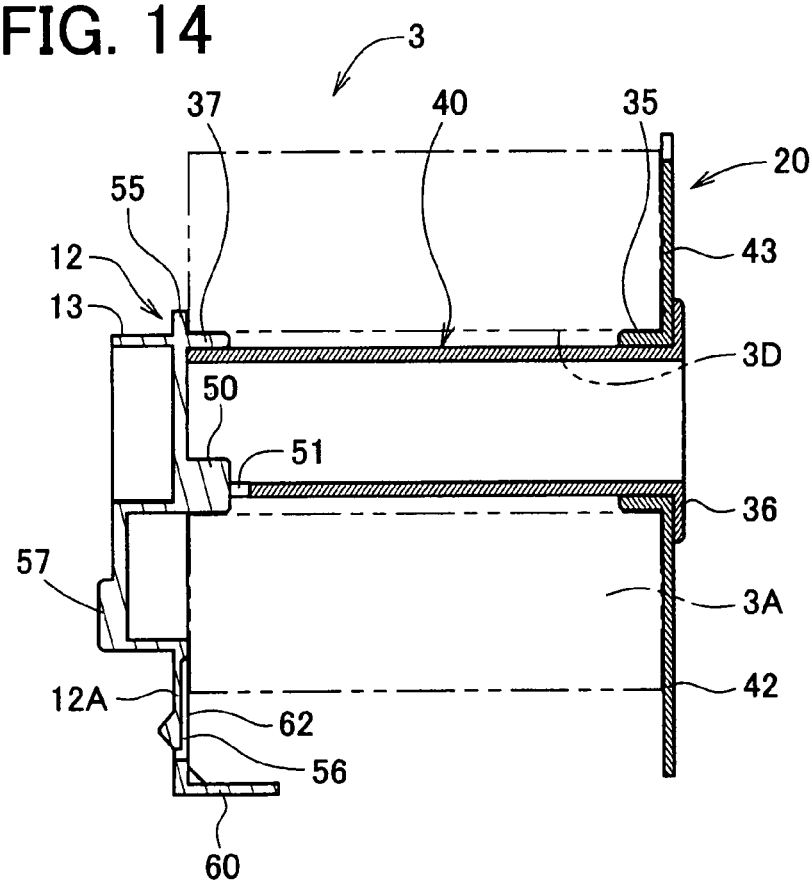
FIG. 14 is a schematic sectional view of the roll sheet holder of the tape printer in the present embodiment, taken along a line Y-Y in FIG. 10A, in which another roll sheet in a rolled state is set.
Figure 15:
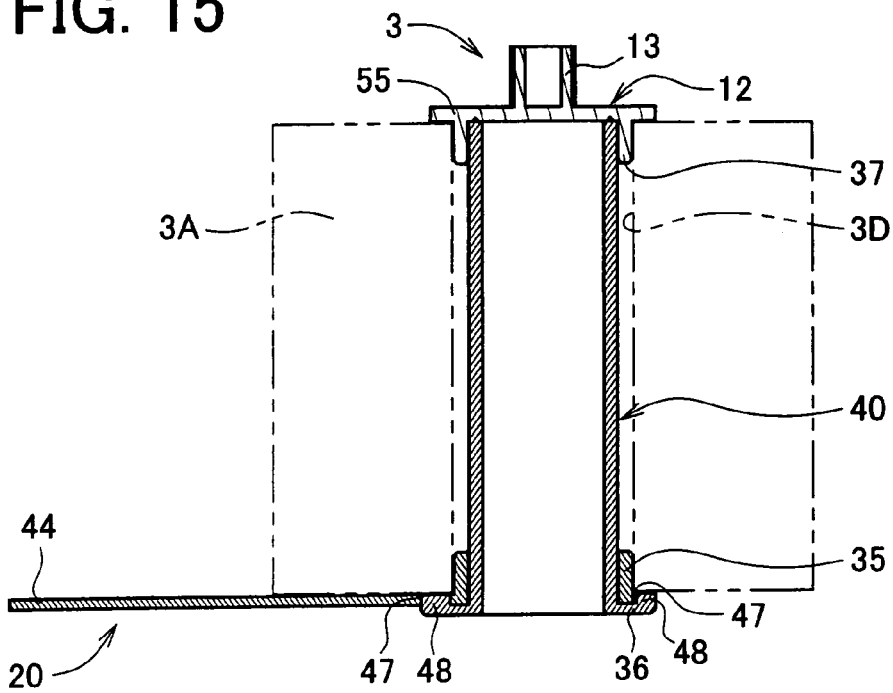
FIG. 15 is a schematic sectional view of the roll sheet holder of the tape printer in the present embodiment, taken along a line Z-Z in FIG. 10A, in which another roll sheet in a rolled state is set.

The present invention may be embodied in other specific forms without departing from the essential characteristics thereof. For instance, each of the roll sheet holders 3 in the above embodiment holds a roll sheet 3A wound on the sheet core 3B. In an alternative, the roll sheet 3A may be rolled up by itself without the sheet core 3B as shown in FIGS. 14 and 15 so that a cylindrical through hole 3D is centrally formed having an inner diameter substantially equal to the outer diameters of the second cylindrical part 37 of the holding member 12 and the first cylindrical part 35 of the guide member 20. With this structure of the roll sheet 3A, eliminating the need for the sheet core 3B, the number of components or parts of the roll sheet holder 3 can be reduced. Further, the maximum length of the roll sheet 3A settable in the roll sheet holder 3 can be increased.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A roll sheet holder which holds a roll sheet wound on a cylindrical sheet core having a through hole opening at both ends and is removably mountable in a tape printer which includes a feeding device which draws the roll sheet to feed an unwound part thereof, and a printing device which prints on the part of the roll sheet fed by the feeding device, wherein the tape printer comprises:

an insertion opening through which the unwound part of the roll sheet is inserted in the tape printer;

a positioning support member vertically provided in a side end of a bottom of the tape printer so that one side of the positioning support member is positioned substantially in one plane with one side end of the insertion opening;

a first positioning groove which is formed in the positioning support member to open upward and at both sides in a direction of a width of the tape printer;

a placing part provided upstream from the insertion opening in a sheet feeding direction; and a second positioning groove which is formed on an upper side of the placing part to open rearward in the sheet feeding direction;

the roll sheet holder comprises:

a guide member which is arranged in contact with one end of the roll sheet and has a front-side extended portion extending outwards so that a front end of the front-side extended portion is positioned outside a front end of the roll sheet of a maximum diameter in the sheet feeding direction; and a positioning holding member which is arranged in contact with the other end face of the roll sheet and has a positioning rib provided protruding in a longitudinal shape on an outer surface of the positioning holding member at a substantially center of a width thereof, the positioning rib being fitted in the first positioning groove when the roll sheet holder is mounted in the tape printer, thereby positioning the roll sheet holder in place in the tape printer.

2. The roll sheet holder according to claim 1, wherein the positioning holding member includes a guide part formed on an outer surface of the positioning rib and extending outwards in a predetermined length from each of both sides of the outer surface of the positioning rib to have a larger width than the positioning rib, and the positioning rib will be fitted in the positioning groove while the positioning support member is positioned between the outer surface of the positioning holding member and the guide part.

3. The roll sheet holder according to claim 1, wherein the positioning holding member is formed to extend downward so that a lower end of the positioning holding member is positioned below a lower end of an outer peripheral surface of the roll sheet, and the positioning holding member is provided with a second extended portion extending in a predetermined length from the lower end of the positioning holding member to face the outer peripheral surface of the roll sheet.

4. The roll sheet holder according to claim 3, wherein the second extended portion is placed vertically right below a central axis of the roll sheet.

5. The roll sheet holder according to claim 3, wherein the tape printer comprises:

a discrimination recess formed with a predetermined depth in the bottom of the tape printer adjacent to a base end of the positioning support member on a roll sheet side; and a sheet discrimination sensor arranged in a bottom of the recess; and the second extended portion includes a roll sheet detection part which detects the kind of the roll sheet in cooperation with the sheet discrimination sensor.

6. The roll sheet holder according to claim 5, wherein the roll sheet detection part includes a through hole arranged according to the kind of the roll sheet, and the through hole is configured to receive the sheet discrimination sensor positioned in correspondence with the through hole when the roll sheet holder is mounted in the tape printer.

7. A roll sheet holder which holds a roll sheet wound to centrally form a through hole and is removably mountable in a tape printer which includes a feeding device which draws the roll sheet to feed an unwound part thereof, and a printing device which prints on the part of the roll sheet fed by the feeding device, wherein the tape printer comprises:

an insertion opening through which the unwound part of the roll sheet is inserted in the tape printer;

a positioning support member vertically provided in a side end of a bottom of the tape printer so that one side of the positioning support member is positioned substantially in one plane with one side end of the insertion opening;

a first positioning groove which is formed in the positioning support member to open upward and at both sides in a direction of a width of the tape printer; and a placing part provided upstream from the insertion opening in a sheet feeding direction; and a second positioning groove which is formed on an upper side of the placing part to open rearward in the sheet feeding direction;

the roll sheet holder comprises:

a guide member which is arranged in contact with one end of the roll sheet and has a front-side extended portion extending outwards so that a front end of the front-side extended portion is positioned outside a front end of the roll sheet of a maximum diameter in the sheet feeding direction, and;

a positioning holding member which is arranged in contact with the other end face of the roll sheet and has a positioning rib provided protruding in a longitudinal shape on an outer surface of the positioning holding member at a substantially center of a width thereof, the positioning rib being fitted in the first positioning groove when the roll sheet holder is mounted in the tape printer, thereby positioning the roll sheet holder in place in the tape printer.

8. The roll sheet holder according to claim 7, wherein the positioning holding member includes a guide part formed on an outer surface of the positioning rib and extending outwards in a predetermined length from each of both sides of the outer surface of the positioning rib to have a larger width than the positioning rib, and the positioning rib will be fitted in the positioning groove while the positioning support member is positioned between the outer surface of the positioning holding member and the guide part.

9. The roll sheet holder according to claim 7, wherein the positioning holding member is formed to extend downward so that a lower end of the positioning holding member is positioned below a lower end of an outer peripheral surface of the roll sheet, and the positioning holding member is provided with a second extended portion extending in a predetermined length from the lower end of the positioning holding member to face the outer peripheral surface of the roll sheet.

10. The roll sheet holder according to claim 9, wherein the second extended portion is placed vertically right below a central axis of the roll sheet.

11. The roll sheet holder according to claim 9, wherein the tape printer comprises:

a discrimination recess formed with a predetermined depth in the bottom of the tape printer adjacent to a base end of the positioning support member on a roll sheet side; and a sheet discrimination sensor arranged in a bottom of the recess; and the second extended portion includes a roll sheet detection part which detects the kind of the roll sheet in cooperation with the sheet discrimination sensor.

12. The roll sheet holder according to claim 11, wherein the roll sheet detection part includes a through hole arranged according to the kind of the roll sheet, and the through hole is configured to receive the sheet discrimination sensor positioned in correspondence with the through hole when the roll sheet holder is mounted in the tape printer.

* * * * *